United States Patent [19]

Longworth et al.

[11] Patent Number: 4,989,769

[45] Date of Patent: Feb. 5, 1991

[54] BLADE GUARD

[75] Inventors: Frederic A. Longworth, St. Paul; Todd R. Betterley, Hastings, both of Minn.

[73] Assignee: Minnesota Mining and Manufacturing Company, Saint Paul, Minn.

[21] Appl. No.: 383,040

[22] Filed: Jul. 20, 1989

[51] Int. Cl.[5] ..... B26F 3/02

[52] U.S. Cl. ..... 225/20; 156/527; 225/77

[58] Field of Search ..... 156/527, 523, 244.11, 156/244.25; 225/19, 20, 77; 264/241, 177.1

[56] References Cited

U.S. PATENT DOCUMENTS

Re. 30,787 11/1981 Pool et al. ..... 156/527

3,552,614 1/1971 Wilson et al. ..... 225/20

4,379,019 4/1983 Pool ..... 156/527

*Primary Examiner*—Michael G. Wityshyn

*Attorney, Agent, or Firm*—Donald M. Sell; Walter N. Kirn; William L. Huebsch

[57] ABSTRACT

A guard for teeth on a cutting blade comprising a guard portion having a side part adapted to lay along one side of the teeth and a projecting part adapted to project past the points of the teeth, an anchor portion adapted to be fixed to the blade at a position spaced from the teeth, and a hinge portion of resiliently flexible polymeric material joining the guard and anchor portions. The hinge portion affords movement of the guard portion relative to the anchor portion from a normal protecting position along and projecting past the teeth, to a cut position spaced from the teeth so that the teeth can be used to cut material, while biasing the guard portion to its normal protecting position.

14 Claims, 1 Drawing Sheet

BLADE GUARD

TECHNICAL FIELD

This invention relates to cut off blades for cutting sheet material on sheet material dispensing devices.

BACKGROUND

Devices such as those described in U.S. Pat. Nos. Re. 30,787 and 4,379,019 are well known for applying a strip of masking tape along one edge of a sheet of masking material with a portion of the tape extending past the edge of the masking material by which the masking material may be temporarily attached along a surface to be protected, such as during painting of an adjacent surface. Typically such devices include a cut off blade by which the tape and sheet of masking material may be severed after a desired length thereof has been withdrawn from the device.

U.S. patent application Ser. No. 116,508 entitled "Sheet Material for Masking Apparatus" filed Nov. 2, 1987, now abandoned, describes a roll of thin polymeric masking material intended for use on the type of device described in U.S. Pat. Nos. Re. 30,787 and 4,379,019, which masking material is a wide sheet folded back and forth upon itself to shorten the length of the roll so that after application of the tape to the masking material and to a surface to be masked the sheet of masking material must be unfolded to obtain the benefit of its full width. The cut off blade normally used in that device, however, does not readily cut the multiple layers of such folded polymeric material, particularly when several folds are present (e.g., over 2 folds).

U.S. patent application Ser. No. 283,237 entitled "Cut Off Blade for Severing Multiple Layers of Thin Polymeric Sheet Material" filed Dec. 12, 1988, now U.S. Pat. No. 4,913,767 describes a cut off blade with a cutting edge portion that is particularly efficient at severing a polymeric sheet of masking material folded in multiple layers. Generally that cut off blade comprises a thin metal sheet including a plurality of similarly shaped teeth providing a cutting edge portion of the blade, each of which teeth defines parts of first and second major surfaces of the blade in the shapes of isosceles triangles having bases adjacent the attachment portion and aligned in a first direction along the blade so that points of the triangular surface parts project at right angles to the first direction. The teeth provided are relatively sharp and long so that with easily applied manual force the teeth can pierce multiple layers of polymeric sheet material (e.g., up to 24 layers) to prevent any of the layers from slipping on the cutting edge, and can then progressively cut through the layers to complete the cut.

While the cutting edge on the cut off blade described in U.S. patent application Ser. No. 283,237 is very effective in cutting layers of polymeric sheet material, its very sharp teeth present the potential for damage to an object with which it comes in contact or injury to a user of the device.

DISCLOSURE OF INVENTION

The present invention provides a guard for a cut off blade that restricts inadvertent contact with its cutting edge, thereby greatly restricting the potential for damage to an object or injury to a user of a device on which the blade is mounted, while being easily retractable so that the cutting edge can easily be engaged with sheet material it is intended to sever.

According to the present invention there is provided a guard for a cutting blade having a plurality of similarly shaped teeth providing a cutting edge portion of the blade, the teeth defining parts of a first surface of the blade generally in the shapes of triangles having bases aligned in a first direction along the blade with the points of the teeth projecting away from the first direction. The guard comprises a guard portion having a side part adapted to lay along the first surface of the blade including the parts of the first surface defined by the teeth and a projecting part adapted to project past the points of the teeth, an anchor portion having a side surface adapted to be fixed to the first surface of the blade at a position spaced from the bases of the generally triangular parts of the first surface, and a hinge portion of resiliently flexible polymeric material joining the guard and anchor portions. When the anchor portion is fixed to the blade the hinge portion affords movement of the guard portion relative to the anchor portion from a normal protecting position to position the side part along the first surface of the blade, to a cut position with the guard portion at a position spaced from the teeth. The hinge portion also biases the guard portion to its normal protecting position.

The anchor portion is adapted to be spaced from the teeth of the blade so that in the cut position of the projecting portion the teeth can fully engage and pass through masking material the blade is intended to cut.

The distal edge of the projecting part is adapted to project at least 0.3 centimeter (0.12 inch) and preferably 0.95 centimeter (0.38 inch) past the tips of the teeth so that the guard portion will automatically be moved fully away from the teeth by engagement with a length of masking material tensioned between the masking machine and a surface to which a portion of the masking material is adhered or a portion of the masking material being held by a user of the masking machine as the teeth are pressed into engagement with that masking material to sever it. Also, preferably the projecting part includes a ridge positioned in opposition to the points of the teeth when the guard portion is in its normal protecting position to help restrict contact with the teeth when the guard portion is in its normal protecting position.

Also, preferably the anchor, hinge, and guard portions are a co-extrusion of polymeric materials.

BRIEF DESCRIPTION OF DRAWING

The present invention will be further described with reference to the accompanying drawing wherein like reference numerals refer to like parts in the several views, and wherein:

FIGS. 3 and 4 are end views of the blade guard, cutting blade and fragment of a masking machine of FIG. 2 in which FIG. 3 illustrates a guard portion of the blade guard in a normal protecting position, whereas FIG. 4 illustrates the guard portion in a cut position so that masking material illustrated can be cut on the cutting blade.

DETAILED DESCRIPTION

Figure 2:
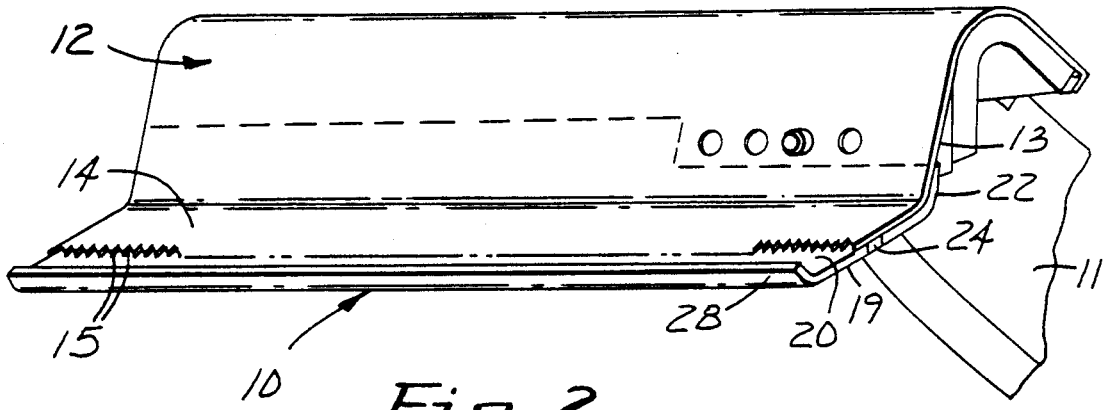
FIG. 2 is a perspective view of the blade guard of FIG. 1 attached to a cutting blade on a fragment of a masking machine.
Figure 1:
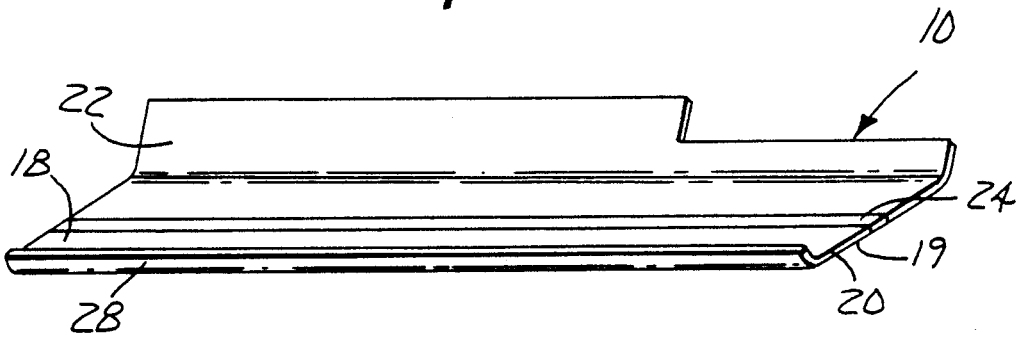
FIG. 1 is a perspective view of a blade guard according to the present invention.

Referring now to the drawing, there is shown a blade guard according to the present invention generally designated by the reference numeral 10.

Figure 3:
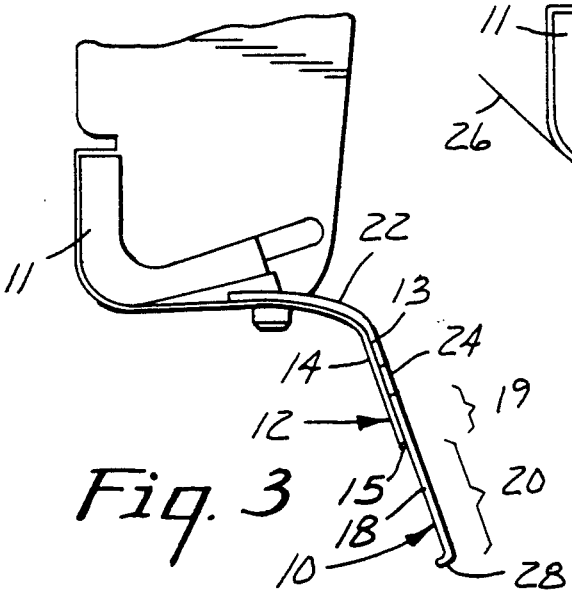
Figure 4:
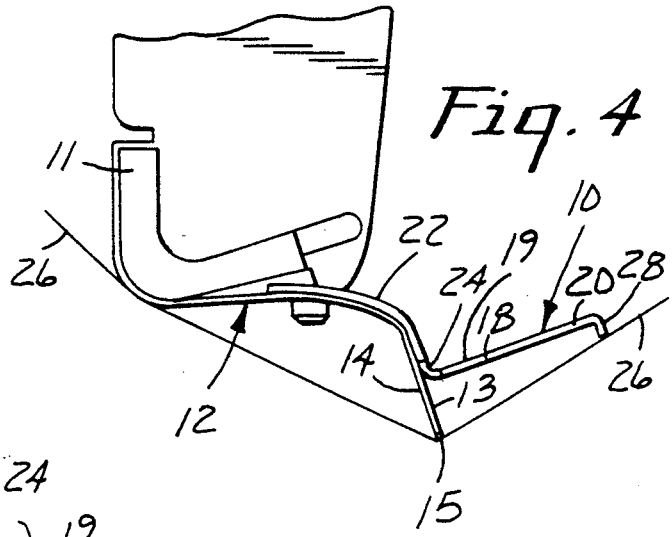

Generally the blade guard 10 is for use with a cutting blade 12 illustrated in FIGS. 2, 3 and 4 attached to a part 11 of a masking machine such as the masking machine described in U.S. Pat. No. Re 30,787 (the content whereof is incorporated herein by reference). The cutting blade 12 has opposite first and second major surfaces 13 and 14 and a plurality of similarly shaped teeth 15 providing a cutting edge portion of the blade 12, which teeth 15 define parts of the first and second surfaces 13 and 14 of the blade 12 generally in the shapes of triangles having bases aligned in a first direction longitudinally along the blade 12 with the points of the teeth projecting away from the first direction.

The blade guard 10 comprises (1) a guard portion 18 having a side part 19 adapted to lay along the first surface 13 of the blade including the parts of the first surface 13 defined by the teeth 15, and a projecting part 20 adapted to project past the points of the teeth 15, (2) an anchor portion 22 having a side surface adapted to be fixed as by a suitable layer of adhesive to the first surface 13 of the blade 12 at a position spaced from the teeth 15, and (3) a hinge portion 24 of resiliently flexible polymeric material joining the guard and anchor portions 18 and 22. The hinge portion 24 affords, when the anchor portion 22 is fixed to the blade 12 as is illustrated in FIGS. 2, 3 and 4, movement of the guard portion 18 relative to the anchor portion 22 from a normal protecting position (FIGS. 2 and 3) at which the side part 19 is along the first surface 13 of the blade 12, to a cut position (FIG. 4) with the guard portion 18 spaced from the teeth 15 so that a length of masking material 26 can be cut on the teeth 15. Also the resilience of the polymeric material in the hinge portion 24 biases the guard portion 18 to its normal protecting position.

The anchor portion 22 is adapted to be spaced from the teeth 15 of the blade 12 so that in the cut position of the guard portion 18 the teeth 15 can fully engage and pass through masking material the blade 12 is intended to cut.

The guard portion 18 is generally L-shaped and includes a ridge 28 on its projecting part 20 that defines the distal edge of the guard portion 18 and is positioned in opposition to and spaced from the points of the teeth 15 when the guard portion 18 is in its normal protecting position. The ridge 28 projects slightly past the full thickness of the blade 12 between its surfaces 13 and 14 to help restrict contact with the teeth 15 when the guard portion 18 is in its normal protecting position.

The distal edge of the projecting part 20 is adapted to project at least 0.3 centimeter (0.12 inch) and preferably 0.95 centimeter (0.38 inch) past the tips of the teeth 15 so that, as is illustrated in FIG. 4, the guard portion 18 will automatically be moved fully away from the teeth 15 by engagement with a length of masking material 26 tensioned between the masking machine 10 and either a surface to which a portion of the masking material 26 is adhered or a portion of the masking material being held by a user of the masking machine as the teeth 15 are pressed into engagement with that masking material 26 to sever it.

As illustrated, the anchor, hinge, and guard portions 22, 24, and 18 of the blade guard 10 are a co-extrusion of polymeric materials, with the anchor and guard portions 22 and 24 being of a relatively stiff polymeric material (e.g., 0.56 centimeter (0.22 inch) thick polyvinyl chloride), and the hinge portion 24 being of a relatively resiliently flexible polymeric material (e.g., 0.56 centimeter (0.18 inch) thick polyurethane) so that essentially all the bending required to afford movement of the guard portion 18 from its normal protecting position (FIGS. 2 and 3) to its cut position (FIG. 4) occurs in the hinge portion 24.

The blade guard 10 is particularly useful when the cutting blade 12 is of the type described in U.S. patent application Ser. No. 283.237 filed Dec. 12, 1988, (the content whereof is incorporated herein by reference) in which cutting blade the angle between the second surface 14 and any portion of an edge surface along the cutting edge portion when measured in a plane normal to the first direction is the same acute angle in the range of 15 to 45 degrees and preferably 30 degrees, and the metal of the sheet at the edge surface along the cutting edge portion of the blade has cold flowed toward the intersection thereof with the second major surface to define a very sharp edge at that intersection. Also, the distance between the points on adjacent ones of the teeth is in the range of 0.1 to 0.32 centimeter (0.04 to 0.125 inch) and preferably 0.23 centimeter (0.09 inch); the dimension between the point and the base on each tooth is in the range of 0.25 to 0.5 centimeter (0.1 to 0.2 inch) and preferably 0.33 centimeter (0.129 inch); and the included angle at the tip of each tooth measured in the plane of the surfaces 13 and 14 is in the range of 30 to 45 degrees and preferably about 38 and one half degrees to provide teeth that with easily applied manual force can pierce multiple layers of polymeric sheet material (e.g., up to 24 layers) to prevent any of the layers from slipping on the cutting edge, and can then progressively cut through the layers to complete the cut.

The present invention has now been described with reference to one embodiment thereof. It will be apparent to those skilled in the art that many changes can be made in the embodiment described without departing from the scope of the present invention. For example, the hinge portion could overlay and be adhered by a layer of adhesive to the anchor and guard portions, rather than being co extruded therewith; or the entire blade guard might be made of one polymeric material with the hinge portion being provided by a thinner section than the anchor and guard portions Thus the scope of the present invention should not be limited to the structure described in this application, but only by structures described by the language of the claims and the equivalents of those structures.

What is claimed:

1. A guard for a cutting blade, the cutting blade having a first surface and a plurality of similarly shaped teeth providing a cutting edge portion of the blade, the teeth defining parts of the first surface of the blade generally in the shapes of triangles having bases aligned in a first direction along the blade with the points of the teeth projecting away from the first direction, said guard comprising a guard portion of polyvinyl chloride having a side part adapted to lay along the first surface of the blade including along the parts of the first surface defined by the teeth and a projecting part adapted to project past the points of the teeth, an anchor portion of polyvinyl chloride having a side surface adapted to be fixed to the first surface of the blade at a position spaced from the bases of the generally triangular shaped parts of the first surface, and a hinge portion of resiliently flexible polyethylene being a coextrusion with and joining said guard and anchor portions, said hinge portion affording when said anchor portion is fixed to the blade movement of said guard portion relative to said anchor portion from a normal protecting position at which said side part is positioned along the first surface of the blade including along the parts of the first surface defined by the teeth, to a cut position with said guard portion at a position spaced from the teeth, and said hinge portion biasing said guard portion to said normal protecting position.

2. A guard according to claim 1 wherein said projecting part includes a ridge positioned in opposition to the points of the teeth when said guard portion is in said normal protecting position.

3. A guard according to claim 1 wherein said projecting part is adapted to project at least 0.3 centimeter past the points of the teeth.

4. A guard according to claim 1 wherein said projecting part is adapted to project about 0.95 centimeter past the points of the teeth.

5. A guard for a cutting blade, the cutting blade having a first surface and a plurality of similarly shaped teeth providing a cutting edge portion of the blade, the teeth defining parts of the first surface of the blade generally in the shapes of triangles having bases aligned in a first direction along the blade with the points of the teeth projecting away from the first direction, said guard comprising a guard portion having a side part adapted to lay along the first surface of the blade including along the parts of the first surface defined by the teeth and a projecting part adapted to project past the points of the teeth, an anchor portion having a side surface adapted to be fixed to the first surface of the blade at a position spaced from the bases of the generally triangular shaped parts of the first surface, and a hinge portion of resiliently flexible polymeric material joining said guard and anchor portions, said anchor and guard portions being of polymeric materials and being relatively stiff compared to said hinge portion, said hinge portion affording when said anchor portion is fixed to the blade movement of said guard portion relative to said anchor portion from a normal protecting position at which said side part is positioned along the first surface of the blade including along the parts of the first surface defined by the teeth to a cut position with said guard portion at a position spaced from the teeth, and said hinge portion biasing said guard portion to said normal protecting position.

6. A guard according to claim 5 wherein said anchor, hinge, and guard portions are a co-extrusion of polymeric materials.

7. A guard according to claim 5 wherein said projecting part includes a ridge positioned in opposition to the points of the teeth when said guard portion is in said normal protecting position.

8. In combination:

a cutting blade having a first surface and a plurality of similarly shaped teeth providing a cutting edge portion of the blade, said teeth defining parts of the first surface of the blade generally in the shapes of triangles having bases aligned in a first direction along the blade with the points of the teeth projecting away from the first direction; and a guard for said cutting blade comprising an anchor portion of polyvinyl chloride having a side surface fixed to the first surface of the blade at a position spaced from said bases, a guard portion of polyvinyl chloride having a side part adapted to lay along the first surface of the blade including along the parts of the first surface defined by said teeth and a projecting part adapted to project past the points of the teeth, and a hinge portion of resiliently flexible polyethylene being a co-extrusion with and joining said guard and anchor portions, said hinge portion affording movement of said guard portion relative to said anchor portion from a normal protecting position to position said side part along the first surface of the blade to a cut position with said guard portion at a position spaced from said teeth, and said hinge portion biasing said guard portion to said normal protecting position.

9. A combination according to claim 8 wherein said projecting part includes a ridge positioned in opposition to and spaced from the points of the teeth when said guard portion is in said normal protecting position.

10. A combination according to claim 8 wherein said projecting part projects at least 0.3 centimeter past the points of said teeth.

11. A combination according to claim 8 wherein said projecting part projects about 0.95 centimeter past the points of said teeth.

12. In combination a cutting blade having a first surface and a plurality of similarly shaped teeth providing a cutting edge portion of the blade, said teeth defining parts of the first surface of the blade generally in the shapes of triangles having bases aligned in a first direction along the blade with the points of the teeth projecting away from the first direction; and a guard for said cutting blade comprising an anchor portion having a side surface fixed to the first surface of the blade at a position spaced from said bases, a guard portion having a side part adapted to lay along the first surface of the blade including along the parts of the first surface defined by said teeth and a projecting part adapted to project past the points of the teeth, and a hinge portion of resiliently flexible polymeric material joining said guard and anchor portions, said anchor and guard portions being of polymeric materials and being relatively stiff compared to said hinge portion, said hinge portion affording movement of said guard portion relative to said anchor portion from a normal protecting position to position said side part along the first surface of the blade to a cut position with said guard portion at a position spaced from said teeth, and said hinge portion biasing said guard portion to said normal protecting position.

13. A combination according to claim 12 wherein said anchor, hinge, and guard portions are a co-extrusion of polymeric materials.

14. A combination according to claim 12 wherein said projecting part includes a ridge positioned in opposition to the points of the teeth when said guard portion is in said normal protecting position.

* * * * *